US006616383B2

(12) United States Patent
Janz

(10) Patent No.: US 6,616,383 B2
(45) Date of Patent: Sep. 9, 2003

(54) SEDIMENT CONTROL BARRIER

(76) Inventor: Arnold J. Janz, Box 40, Site 1, RR3, Fort Saskatchewan, Alberta (CA), T8L 2N9

( * ) Notice: Subject to any disclaimer, the term of this patent is extended or adjusted under 35 U.S.C. 154(b) by 0 days.

(21) Appl. No.: 10/075,303

(22) Filed: Feb. 15, 2002

(65) Prior Publication Data

US 2003/0095833 A1 May 22, 2003

(30) Foreign Application Priority Data

Nov. 19, 2001 (CA) ..... 2363429

(51) Int. Cl.[7] ..... E02B 7/00

(52) U.S. Cl. ..... 405/302.7; 405/302.6; 405/21

(58) Field of Search ..... 405/302.7, 302.6, 405/302.4, 107, 114, 115, 116, 87, 90, 91, 15, 16, 17, 21, 22, 24, 25, 31, 32, 35

(56) References Cited

U.S. PATENT DOCUMENTS

| | | | | | |
|---|---|---|---|---|---|
| 1,318,656 | A | | 10/1919 | Fitzgerald | 405/91 |
| 1,381,427 | A | | 6/1921 | Patrick | 405/91 |
| 1,852,268 | A | | 4/1932 | Schmidt | 405/15 |
| 2,178,863 | A | | 11/1939 | Pepper | 61/35 |
| 2,318,349 | A | | 5/1943 | Wiley | 61/35 |
| 2,515,059 | A | | 7/1950 | Rowbotham | 61/4 |
| 3,037,726 | A | * | 6/1962 | Phillips | 256/12.5 |
| 3,913,889 | A | * | 10/1975 | Nugent et al. | 256/12.5 |
| 4,031,676 | A | | 6/1977 | Dally | 52/102 |
| 4,362,432 | A | | 12/1982 | Conover | 405/33 |
| 4,534,675 | A | * | 8/1985 | Morrisroe | 405/24 |
| 4,756,511 | A | | 7/1988 | Wright, III | 256/12.5 |
| 5,029,819 | A | * | 7/1991 | Kane | 256/12.5 |
| 5,039,250 | A | * | 8/1991 | Janz | 405/302.6 |
| 5,108,224 | A | | 4/1992 | Cabaniss et al. | 405/52 |
| 5,114,270 | A | | 5/1992 | Riddle | 405/15 |
| 5,123,780 | A | * | 6/1992 | Martinsen | 405/30 |
| 5,297,895 | A | | 3/1994 | Johnson | 405/41 |
| 5,345,741 | A | | 9/1994 | Slater et al. | 52/646 |
| 5,348,419 | A | * | 9/1994 | Bailey et al. | 405/21 |
| 5,370,480 | A | | 12/1994 | Quaney | 405/284 |
| 5,405,217 | A | * | 4/1995 | Dias et al. | 405/302.6 |
| 5,419,659 | A | * | 5/1995 | Mercer | 405/302.7 |
| 5,605,416 | A | * | 2/1997 | Roach | 405/21 |
| 5,622,448 | A | | 4/1997 | Baum et al. | 405/15 |
| 5,795,099 | A | * | 8/1998 | Parker | 405/302.6 |
| 5,921,709 | A | * | 7/1999 | Baum et al. | 405/114 |
| 5,961,251 | A | * | 10/1999 | Prendergast | 405/24 |

FOREIGN PATENT DOCUMENTS

| | | | |
|---|---|---|---|
| CA | 1304975 | 7/1992 | E04H/17/00 |

OTHER PUBLICATIONS

Aqua Treatment Systems, Inc., product information sheet, 1 page, undated, but is known to precede date of filing of priority application.

Triangular Silt Dike Company Inc., product information, including: Sample specification, one page, undated. Product information sheet, one page, undated. Drawings, 5 pages, undated. Photographs, 1 page, undated. Each known to precede date of filing of priority application.

(List continued on next page.)

*Primary Examiner*—Heather Shackelford
*Assistant Examiner*—Frederick L. Lagman
(74) *Attorney, Agent, or Firm*—Anthony R. Lambert

(57) ABSTRACT

A sediment control barrier, comprising a ground contacting surface having a length suitable for controlling fluid flow across ground, barrier material extending perpendicularly from the ground contacting surface, means for securing the ground contacting surface to the ground; and the barrier material being structured to conform to a ground contour. A sediment control barrier is proposed that has slots to enable flexing of the barrier material. Another sediment control barrier is proposed having a graded permeability from a first, lower, non-zero permeability adjacent the ground contacting surface to a second, higher, permeability away from the ground contacting surface.

16 Claims, 9 Drawing Sheets

OTHER PUBLICATIONS

Cascade Distribution Ltd., product information sheet, *ICEA 30th Annual*, Feb. 22–26, 1999.

Panel Products, Inc., product information, including: Price list, 1 page, Feb. 15, 1999. Product information sheet, 1 page, Jan. 15, 1999.

Nilex Inc., *Geo–Ridge Design Parameters: An Introduction*, 7 pages, Feb. 12, 1999.

From the "Design Manual" of the Missouri Highway & Transportation Department, Section 4–09.5(2), entitled Temporary Erosion and Sediment Control, pp. 7–10, dated May 15, 1995.

A design specification of the Missouri Highway & Transportation Department, entitled: "Temporary Erosion and Sediment Control DSP–93–05A," (12 pages total).

Generic Erosion Control Plans of the Missouri Highway & Transportation Department, denominated as special sheets 1 through 5, each entitled "Temporary Erosion Control Measures," dated Oct. 11, 1993.

* cited by examiner

SEDIMENT CONTROL BARRIER

BACKGROUND OF THE INVENTION

In U.S. Pat. No. 5,039,250 issued Aug. 13, 1991, and Canadian patent no. 1,304,975, issued Jul. 14, 1992, there is disclosed a sediment control barrier to be installed on a ground surface including a transversely stiff folded longitudinal sheet folded downward about a longitudinal axis to form an apex. The longitudinal edges of the sheet are secured to the ground. The sheet has a chosen permeability selected according to its intended application.

While this device has proven successful, the mesh sheets provide constant permeability, which does not accommodate a range of flows. During high flow volume, for a constant permeability, barrier sheets can become clogged, resulting in the device functioning as a ditch block rather than a porous berm. In addition, such a device does not easily conform to a variable height ground surface.

The present invention is directed towards providing an improved sediment control barrier.

SUMMARY OF THE INVENTION

Therefore, according to an aspect of the invention, there is provided a sediment control barrier for installation on a sloped surface such as a ditch that is structured to conform to the sloped surface. In one aspect of the invention, the sediment control barrier comprises a sheet having a length and a height, and a lengthwise extending edge that is secured to the ground across the sloped surface, the sheet extending upwards away from the sloped surface to a distal edge; and slots in the sheet extending downward into the sheet from the distal edge. The slots may have any of various shapes, and may decrease in width away from the distal edge.

In a further aspect of the invention, there is provided a sediment control barrier, comprising a ground contacting surface having a length suitable for controlling fluid flow across ground, barrier material extending perpendicularly from the ground contacting surface, means for securing the ground contacting surface to the ground; and the barrier material having a graded permeability from a first, lower, non-zero permeability adjacent the ground contacting surface to a second, higher, permeability away from the ground contacting surface.

Preferably, the barrier is formed of a self-supporting triangular structure. The barrier material may be made permeable by any of a variety of ways, as for example using slots, or openings. Particularly when slots are used, increasing permeability of the sediment control barrier away from the ground contacting surface, and the consequential differing lengthwise compressibility of the barrier, allows the ground contacting surface to flex and conform to a ground surface. The sediment control barrier is typically used for sediment control on sloped surfaces such as in ditches, but also has utility as a barrier for wind control. The barrier material is preferably itself made of water impermeable material.

In a further aspect of the invention, a sediment control barrier is provided with velocity dissipating legs.

In a still further aspect of the invention, plural barriers may be arranged along a ditch or other sloped surface, with variable permeability, and the upslope barrier having greater permeability.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

In this patent document, the word "comprising" is used in its non-limiting sense to mean that items following the word in the sentence are included and that items not specifically mentioned are not excluded. The use of the indefinite article "a" in the claims before an element means that one of the elements is specified, but does not specifically exclude others of the elements being present, unless, unless the context clearly requires that there be one and only one of the elements.

Figure 1:
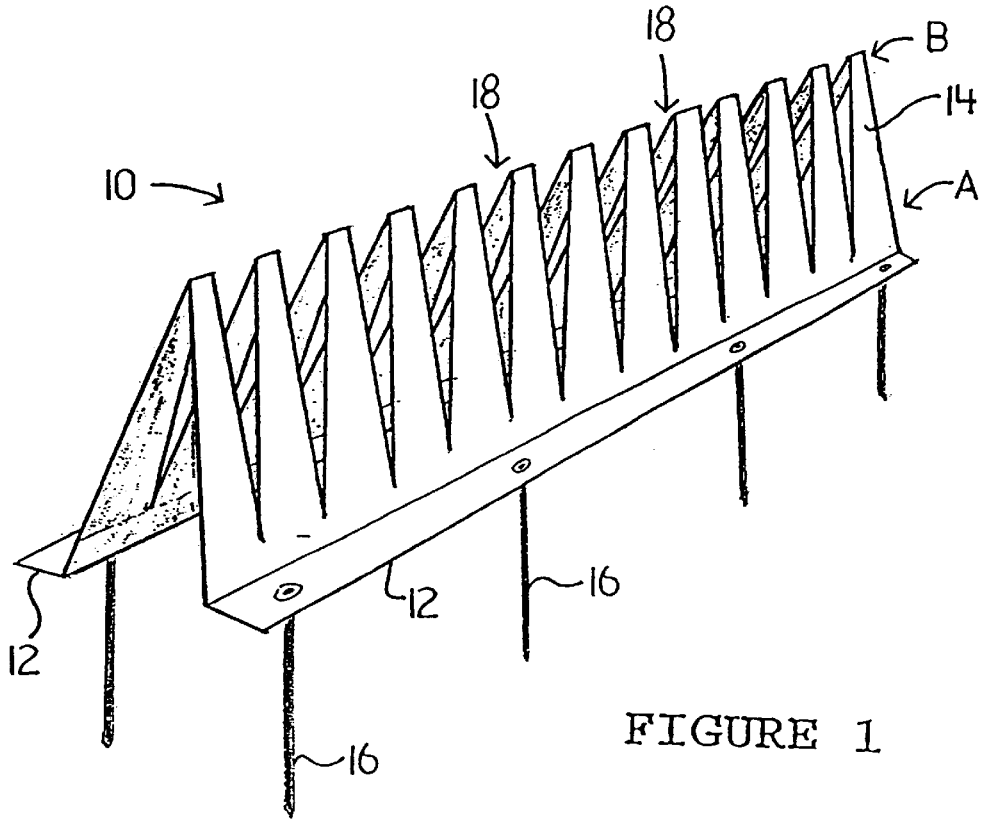
FIG. 1 is a perspective view of a first embodiment of the invention.
Figure 8:
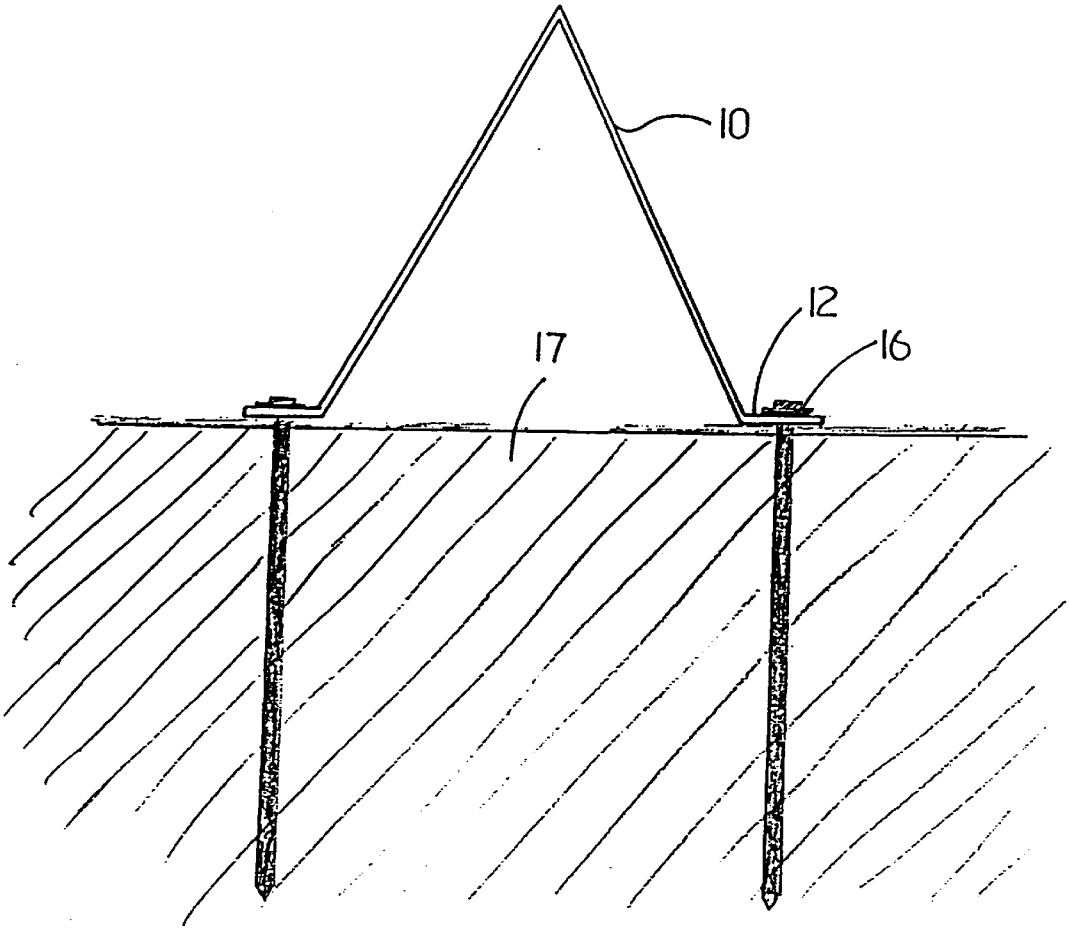
FIG. 8 is a side view of a sediment control barrier according to the invention showing a manner of securing the sediment control barrier to the ground.
Figure 9:
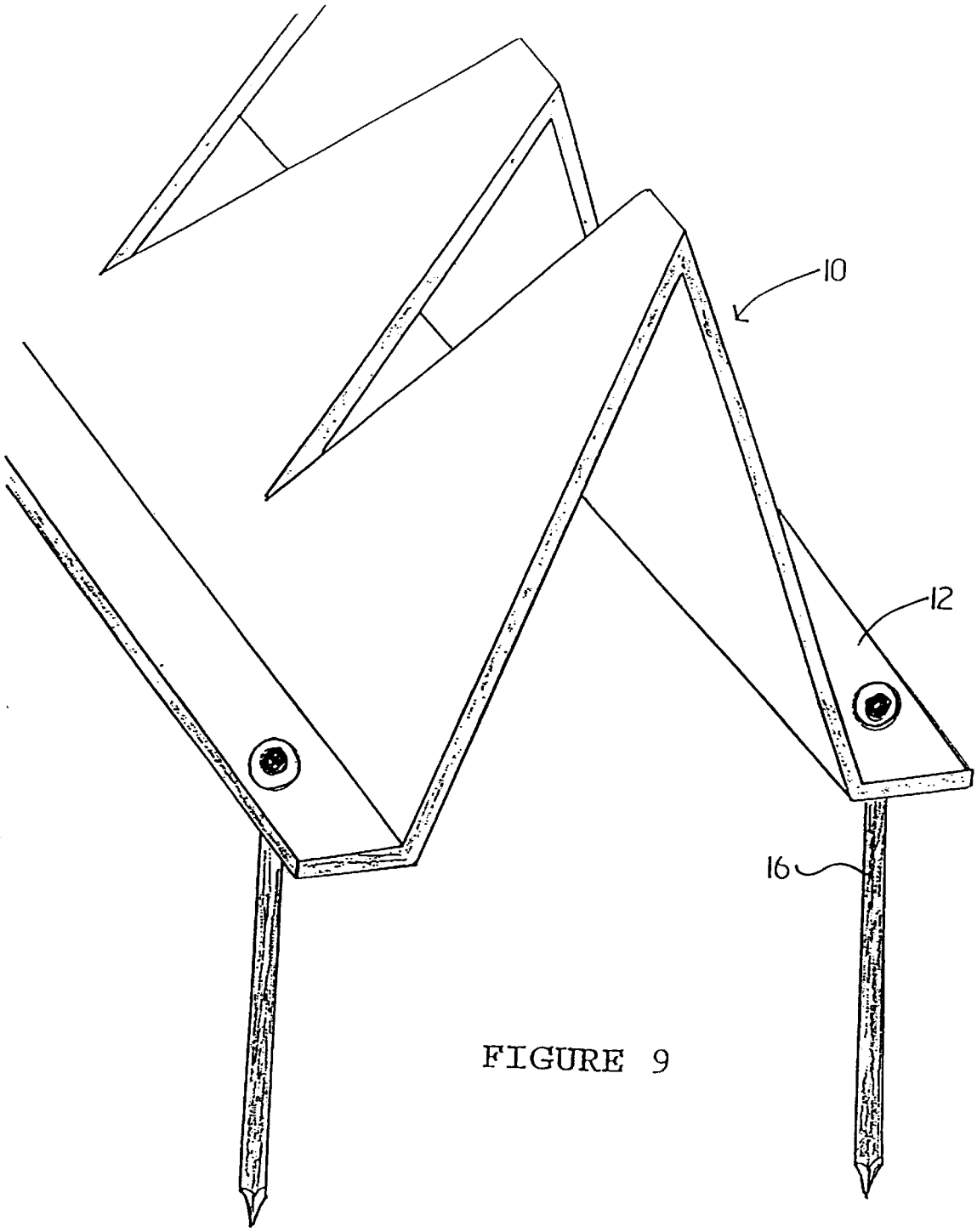
FIG. 9 is a perspective view of the structure of FIG. 8.

Referring to FIG. 1, there is shown a sediment control barrier 10 having a ground contacting surface 12 having a length suitable for controlling fluid flow across ground. The ground could be a ditch, or beach, or on a sloped surface for sediment control, or could be in or along an open space, such as a field, for wind control. Barrier material 14 extends perpendicularly from the ground contacting surface 12. The barrier material 14 could be made from sheet materials such as plastic or steel, and is preferably made of water impermeable material. Mesh materials may also be used. The sediment control barrier 10 is secured to the ground by any of various suitable means such as spikes 16 passing through openings in the ground contacting surface 12 into the ground 17, as shown in more detail in FIGS. 8 and 9. Another way to secure the sediment control barrier 10 to the ground is by placing the ground contacting surface 12 under ground material, for example by piling ground material onto the ground contacting surface 12 or by inserting the ground contacting surface 12 into a slot in the ground. Forming the ground contacting surface 12 into a flap or leg as shown in FIG. 1 also forms a means for securing the ground contacting surface to the ground.

Figure 2:
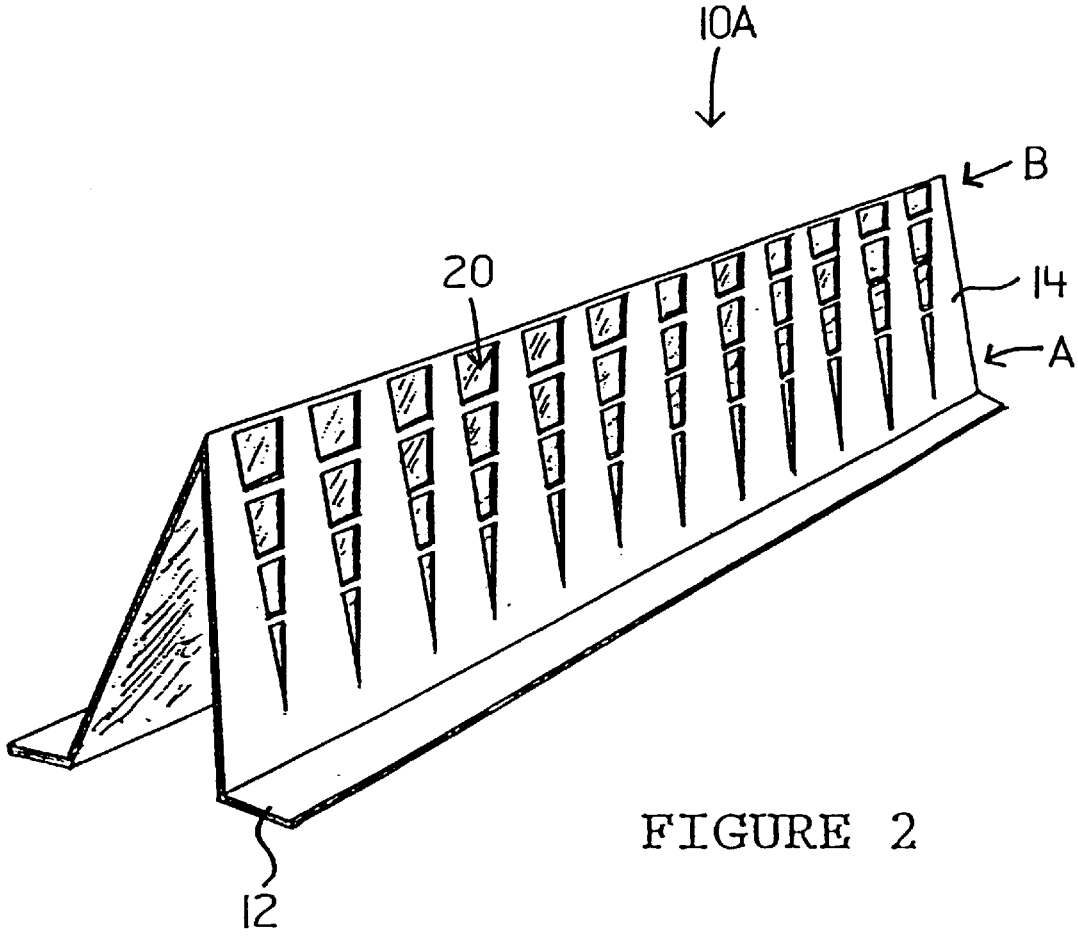
FIG. 2 is a perspective view of a second embodiment of the invention.
Figure 3:
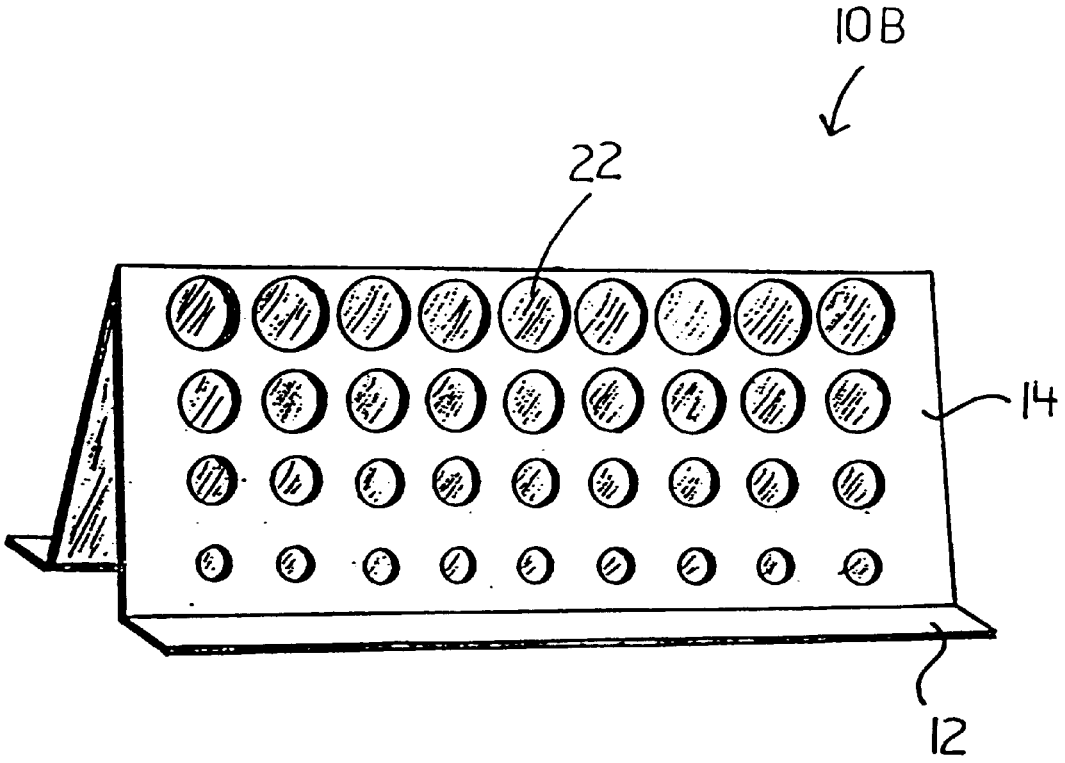
FIG. 3 is a perspective view of a third embodiment of the invention.
Figure 4:
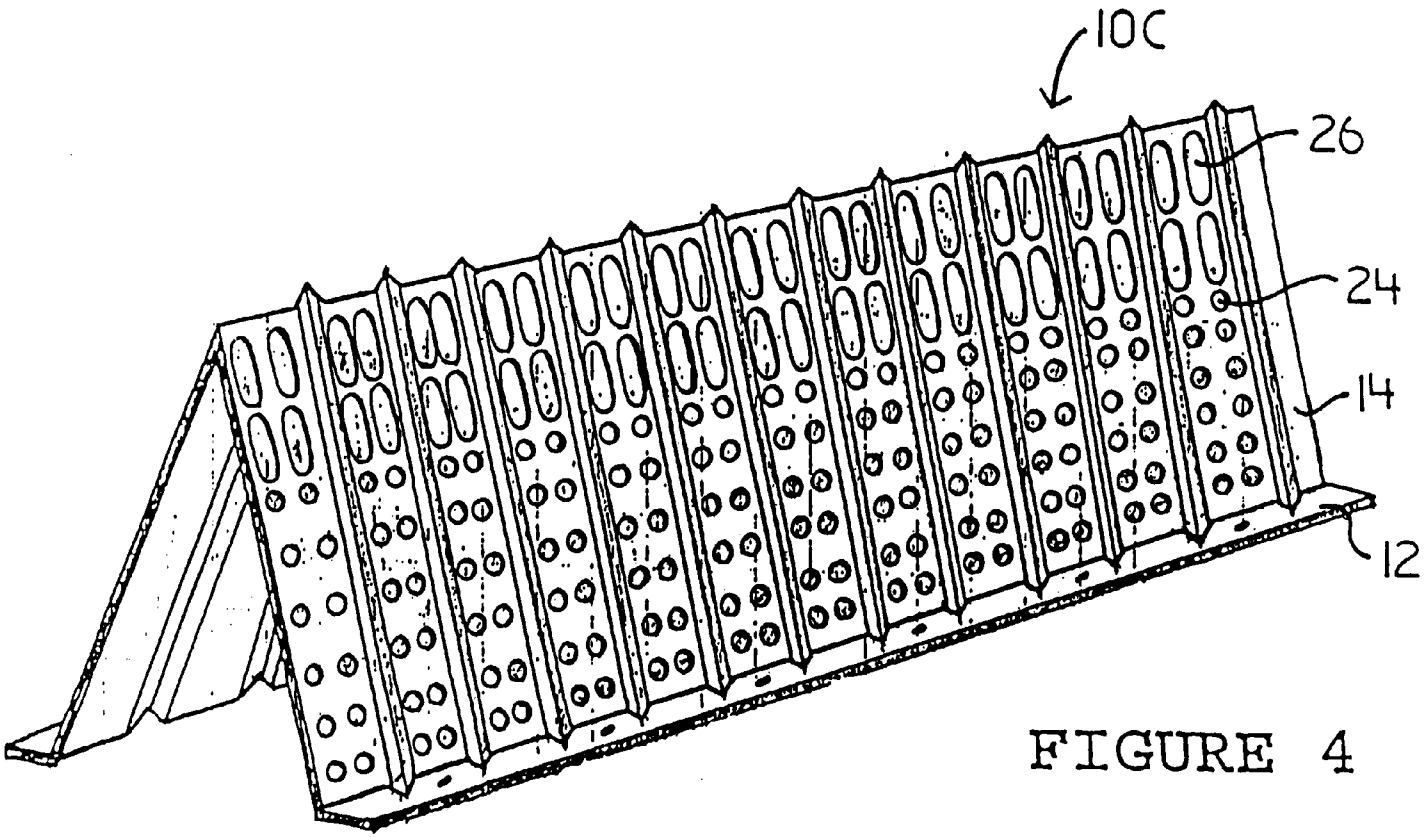
FIG. 4 is a perspective view of a fourth embodiment of the invention.

The barrier material 14 has a graded permeability from a first, lower, non-zero permeability adjacent the ground contacting surface (shown at A) to a second, higher, permeability away from the ground contacting surface (at the distal edge shown at B, where distal is defined in relation to the ground contacting surface). The graded permeability 14 may be accomplished with any of various designs, such as upwardly widening slots 18 (FIG. 1), upwardly opening segmented slots 20 in sediment control barrier 10A (FIG. 2), holes 22 that are larger further away from the ground contacting surface 12 shown in sediment control barrier 10B (FIG. 3), or openings 24 having a first size and larger openings 26 as shown in the sediment control barrier 10C (FIG. 4). Other configurations within the terms of the claims would occur to a person skilled in the art.

As shown in FIGS. 1–4, the barrier material 14 forms a self-supporting triangular structure, made of a material folded to form an apex and secured to the ground on either side of the apex. However, other structures may be formed, such as a single, flat sheet secured to or around posts embedded in the ground, or a sheet secured with stakes to the ground with the stakes passing through parts of the sheet, or blocks of any of various shapes with upwardly increasing openings. When the barrier material 14 is formed into a folded sheet with an apex, as shown in FIG. 1, the slots may be formed simply by cutting into the folded sheet.

Figure 5:
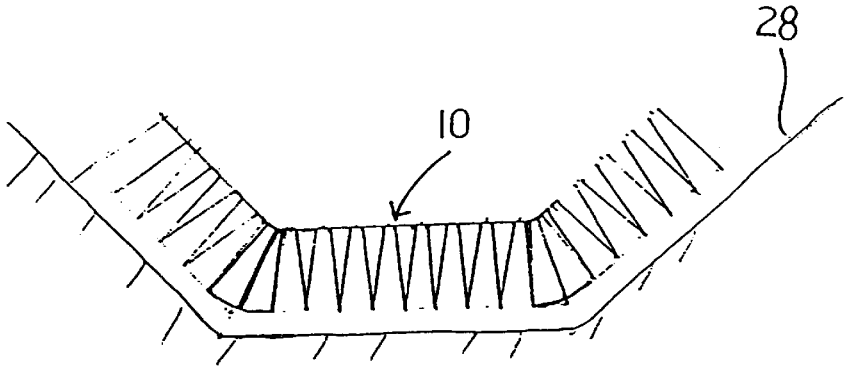
FIG. 5 is a side view showing deformation of an embodiment of the invention upon lengthwise compression to conform to the profile of a ditch.
Figure 6:
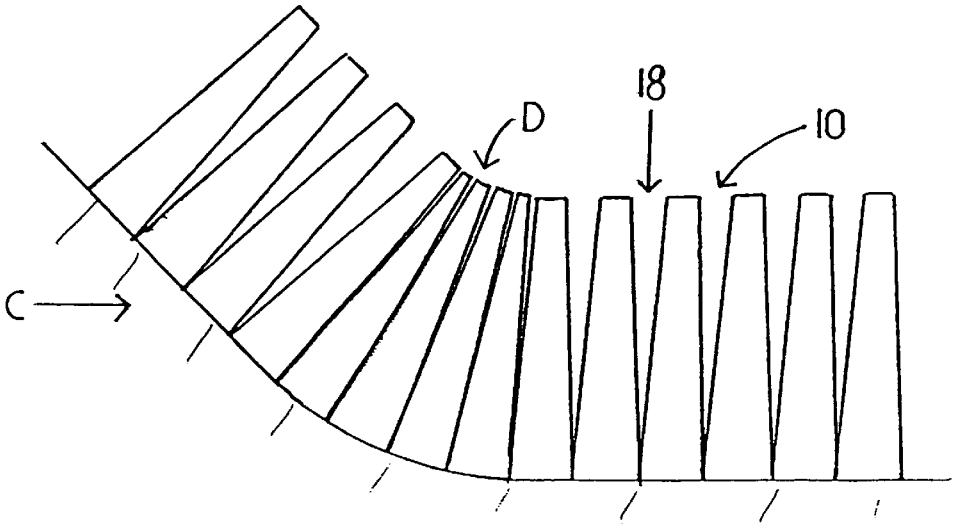
FIG. 6 is a detail of a part of the sediment control barrier of FIG. 5.

With the sediment control barrier 10 of FIG. 1, the barrier material 14, due to the operation of the slots 18, has a graded lengthwise compressibility from a first, lower, compressibility adjacent the ground contacting surface 12 to a second, higher, compressibility away from the ground contacting surface 12. A higher lengthwise compressibility means that the barrier is more easily compressed by pressure acting along its length. As a result, when the sediment control barrier 10 is placed in a ditch 28 having a U-shaped profile as shown in FIG. 5, the ground contacting surface 12 deforms upon lengthwise compression of the barrier material under pressure from the sides of the ditch 28 to conform to the profile of the ditch 28. As shown in FIG. 6, lengthwise compression indicated by the arrow C causes the slots 18 to compress as shown at D.

Figure 7:
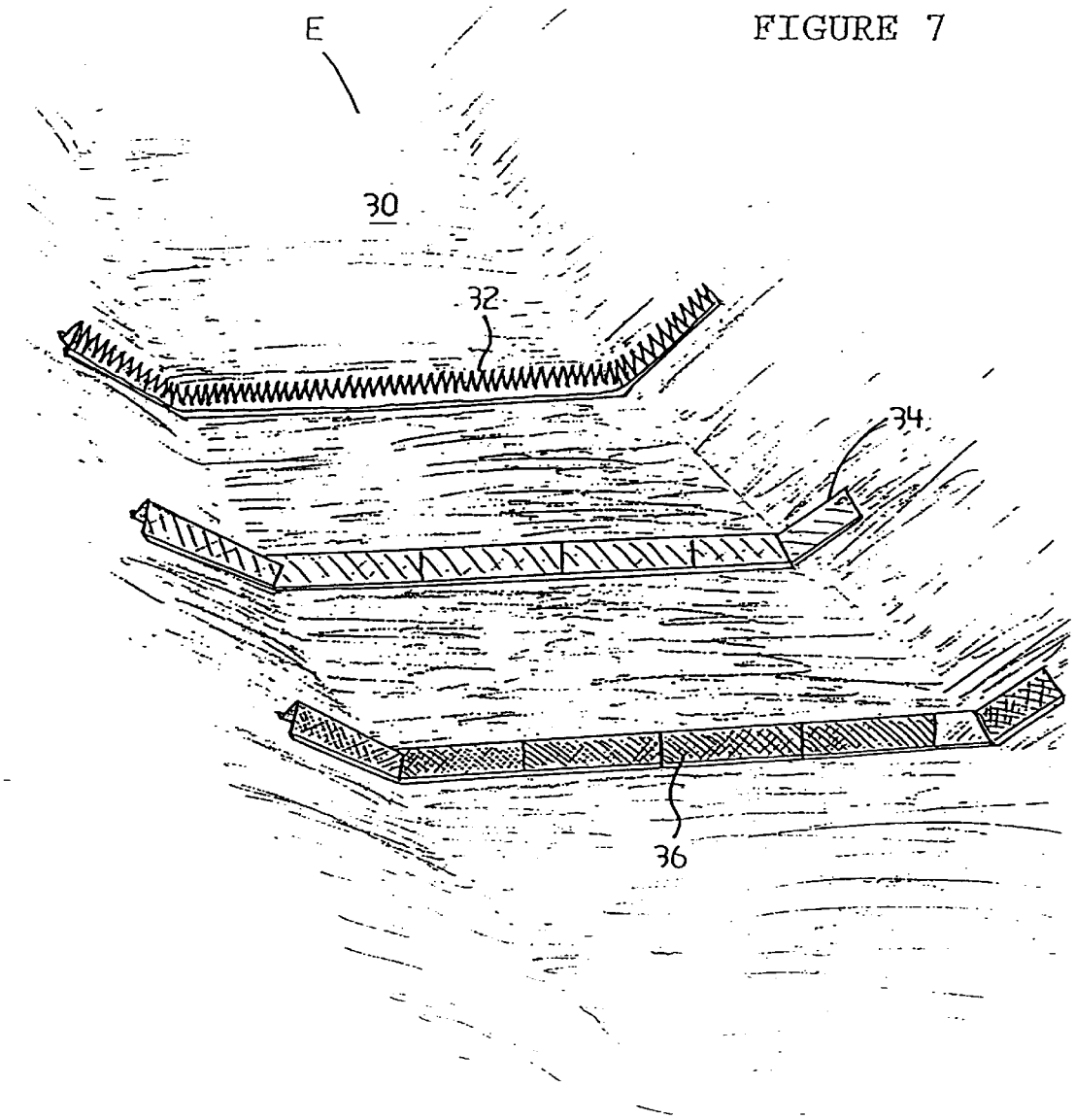
FIG. 7 is a perspective view showing a succession of sediment control barriers with successively higher sediment control barriers having successively higher permeability.

FIG. 7 shows a sediment control structure arranged across a ground surface in a ditch 30. The structure is formed by plural sediment control barriers 32, 34, 36, each sediment control barrier 32, 34, 36 being oriented to control fluid flow across the ground surface, in this case down the ditch 30 in the direction of the arrow E. The sediment control barriers 32, 34, 36 are arranged successively in the direction E of fluid flow across the ground surface in the ditch 30, with successive sediment control barriers having different permeability. Thus, barrier 32 has a higher permeability than barrier 34, and barrier 34 has higher permeability than barrier 36.

The barrier material 14 should be sufficiently stiff and inert or biodegradable for the intended application. Preferably, when a triangular sediment control barrier is used, the apex should be located in the center of the barrier. Vertical bars (not shown) can be added to the barrier material to stiffen the material between the slots. A sediment control barrier may also be formed of multiple like shaped overlapping panels as for example shown in FIG. 7. Multiple barriers 10 of like permeability may also be placed successively down slope in a ditch or across a field. The barriers 10 may be used in conjunction with a pre-secured erosion control mat.

Figure 10:
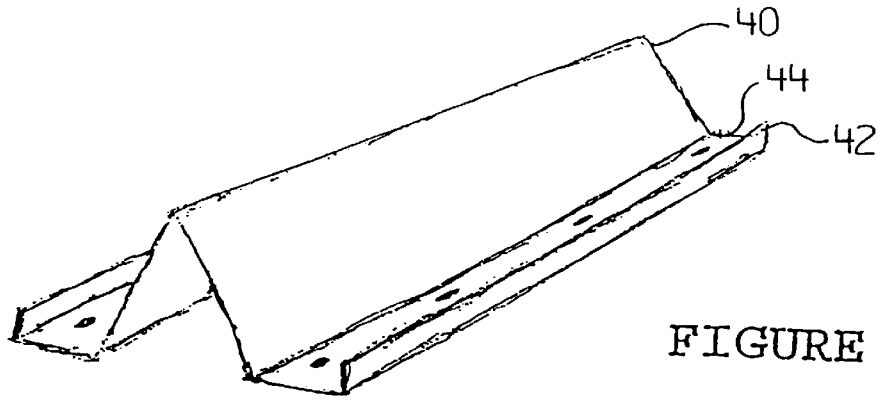
FIG. 10 is a perspective view of a sediment control barrier with water velocity dissipating legs.

Referring to FIG. 10, a sediment control barrier 40 may be provided with velocity dissipating legs 42 that extend upward from flaps 44 used to secure the sediment control barrier 40 to the ground. The velocity dissipating legs 42 may be formed from a folded portion of the sheet forming both the upwardly standing barrier and the ground securing flaps 44. Pins, pegs, spikes, staples, stakes or the equivalent that pass through or over the flaps 44 may be used to secure the flaps 44 to the ground. The velocity dissipating legs 40 may have a height selected depending on the application, and may for example be 2–15 cm high, and may be slotted to allow panel flexibility.

Figure 11:
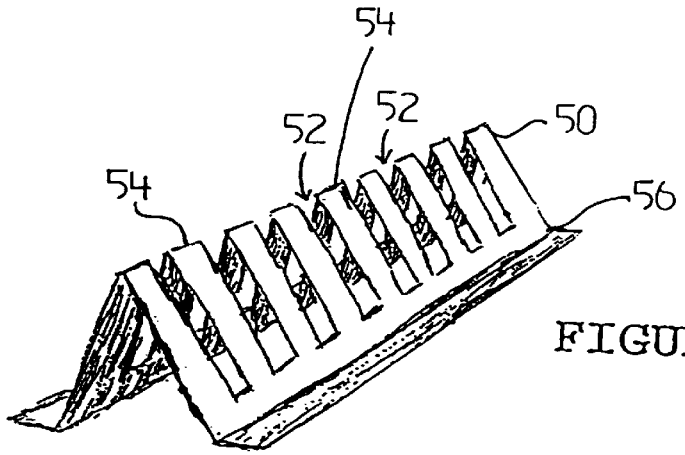
FIG. 11 is perspective view of a sediment control barrier with parallel slots providing the sediment control barrier with a ground conforming flexibility.

Referring to FIG. 11, a sediment control barrier 50 is shown that contours to a concave ground surface, for example a ditch. The sediment control barrier 50 is provided with slots 52 that extend downward into the barrier material from a distal edge 54 towards a ground contacting edge 56. The slots 52 in this case have parallel sides, and may have essentially zero width, as for example by being formed by a single cut into the barrier material downward from the distal edge 56. The lengthwise compressibility of this sediment control barrier 50 also varies with the height of the barrier, due to the cantilever effect of the material of the barrier between the slots 52.

Figure 12:
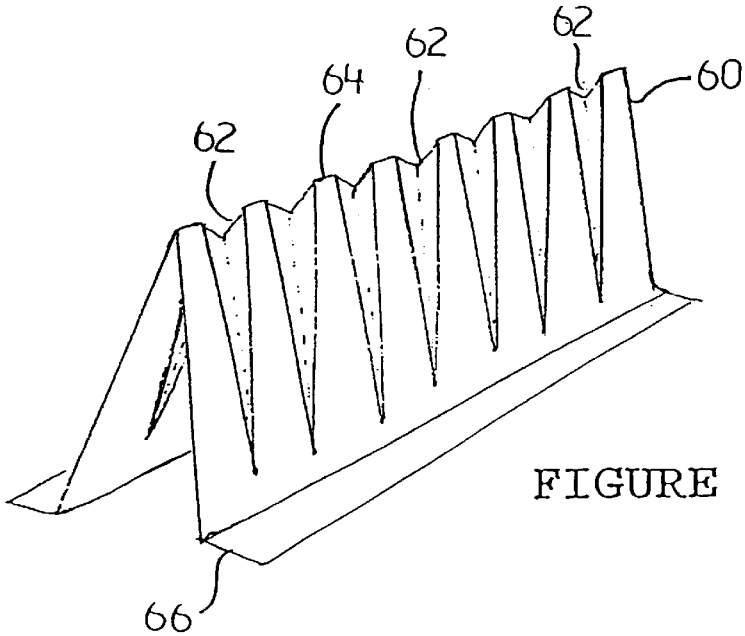
FIG. 12 is a perspective view of a sediment control barrier that is compressible due to impressed folds in the sheet forming the sediment control barrier.

Referring to FIG. 12, a sediment control barrier 60 is shown with impressed folds 62 that decrease in width from a distal edge 64 down towards a ground contacting edge 66. Folding, to cause a crease, and stretching the material prior to installation may be used to make the folds 62. The crease provides a region of worked material that is more easily folded upon installation, and thus permits the sediment control barrier 60 to conform to a ground contacting surface.

The sediment control barrier thus described provides a low profile, porous device that promotes fallout of sediment in runoff water in ditches, channels and on slopes and helps to prevent sediment from reaching and degrading aquatic habitat and quality. The sediment control barrier retards water velocity, increases water depth, reduces scouring and channeling of the ground surface and induces sedimentation.

The variable permeability within each panel accommodates a range of flows. Use of slots and holes also provides non-mesh porosity. Because mesh type porous devices tend to collect and trap non-soil debris, they tend to become clogged as debris collects on the mesh. Debris clogged mesh behaves more like a ditch block than a porous berm. A non-mesh porous berm as provided in this device, will not collect debris to the same extent as a mesh type berm, but will self-clean as debris passes through the slots.

A person skilled in the art could make immaterial modifications to the embodiments described in this patent document without departing from the essence of the invention.

I claim:

1. A sediment control barrier, comprising:

a ground contacting surface having a length suitable for controlling fluid flow on a sloped surface having a profile;

barrier material extending perpendicularly from the ground contacting surface to a distal edge;

means for securing the ground contacting surface to the ground;

the barrier material having a graded lengthwise compressibility from a first, lower, compressibility adjacent the ground contacting surface to a second, higher, compressibility away from the ground contacting surface; and the ground contacting surface being deformable upon lengthwise compression of the barrier material to conform to the profile of the sloped surface.

2. The sediment control barrier of claim 1 in which the second higher compressibility is caused by slots extending into the barrier material from the distal edge.

3. The sediment control barrier of claim 1 in which the barrier material forms a triangular structure.

4. The sediment control barrier of claim 1 in which the barrier material is self-supporting.

5. A sediment control barrier installed on a sloped surface, the sediment control barrier comprising:

a sheet having a length and a height, and a lengthwise extending edge that is secured to the ground across the sloped surface;

the sheet extending upwards away from the sloped surface to a distal edge;

slots in the sheet extending downward into the sheet from the distal edge; and the sheet being self-supporting on a ground surface exposed to air.

6. The sediment control barrier of claim 5 in which the slots decrease in width away from the distal edge.

7. A sediment control barrier installed on a sloped surface, the sediment control barrier comprising:

a sheet having a length and a height and a lengthwise extending edge that is secured to the ground across the sloped surface;

the sheet extending upwards away from the sloped surface to a distal edge;

slots in the sheet extending down into the sheet from the distal edge, the slots decreasing in width away from the distal edge.

8. The sediment control barrier of claim 7 in which the sheet is water impermeable except at the slots.

9. A sediment control barrier, comprising:

a ground contacting surface having a length suitable for controlling fluid flow across sloped ground;

barrier material extending perpendicularly from the ground contacting surface;

means for securing the ground contacting surface to the sloped ground;

the barrier material having a graded permeability from a first, lower, non-zero permeability adjacent the ground contacting surface to a second, higher, permeability away from the ground contacting surface; and the barrier material being deformable to conform to the surface of the sloped ground.

10. A sediment control barrier, comprising:

a ground contacting surface having a length suitable for controlling fluid flow across ground;

barrier material extending perpendicularly from the ground contacting surface;

means for securing the ground contacting surface to the ground;

the barrier material having a graded permeability from a first, lower, non-zero permeability adjacent the ground contacting surface to a second, higher, permeability away from the ground contacting surface; and the first permeability and the second permeability each being created by multiple rows of openings forming a mid across the entire surface of the barrier material, the slots of succeeding rows increasing in size with distance away from the ground contacting surface.

11. The sediment control barrier of claim 10 in which the barrier material is made of mesh.

12. A sediment control barrier, comprising:

a ground contacting surface having a length suitable for controlling fluid flow across ground;

barrier material extending perpendicularly from the ground contacting surface;

means for securing the ground contacting surface to the ground;

the barrier material having a graded permeability from a first, lower, non-zero permeability adjacent the ground contacting surface to a second, higher, permeability away from the ground contacting surface;

the graded permeability being created by openings in the barrier material that increase in size away from the ground contacting surface; and the openings being arranged in a series of rows across the barrier material, the series of rows including an uppermost row, the openings of the uppermost row providing a permeability of greater than 50%.

13. The sediment control barrier of claim 12 in which the barrier material is made of mesh.

14. A sediment control barrier installed across sloped ground, the sediment control barrier comprising:

a ground contacting surface having a length suitable for controlling fluid flow across the sloped ground;

barrier material extending perpendicularly from the ground contacting surface;

the ground contacting surface being secured to the sloped ground with the barrier material extending away from the sloped ground;

the barrier material having a graded permeability from a first, lower, non-zero permeability adjacent the ground contacting surface to a second, higher, permeability away from the ground contacting surface; and the barrier material being deformable to conform to the surface of the sloped ground.

15. A sediment control barrier installed across sloped ground, the sediment control barrier comprising:

a ground contacting surface having a length suitable for controlling fluid flow across the sloped ground;

mesh barrier material extending perpendicularly from the ground contacting surface;

the ground contacting surface being secured to the sloped ground with the mesh barrier material extending away from the sloped ground;

the mesh barrier material having a graded permeability from a first, lower, non-zero permeability adjacent the ground contacting surface to a second, higher, permeability away from the ground contacting surface; and the graded permeability being created by slots in the mesh barrier material that increase in width with distance away from the ground contacting surface.

16. A sediment control barrier installed across sloped ground, the sediment control barrier comprising:

a ground contacting surface having a length suitable for controlling fluid flow across the sloped ground;

barrier material extending perpendicularly from the ground contacting surface;

the ground contacting surface being secured to the sloped ground with the barrier material extending away from the sloped ground;

the barrier material having a graded permeability from a first, lower, non-zero permeability adjacent the ground contacting surface to a second, higher, permeability away from the ground contacting surface;

the graded permeability being created by openings in the barrier material that increase in size away from the ground contacting surface; and the openings being arranged in a series of rows across the barrier material, the series of rows including an uppermost row, the openings of the uppermost row providing a permeability of greater than 50%.

* * * * *